US007748830B2

(12) United States Patent
Platt et al.

(10) Patent No.: US 7,748,830 B2
(45) Date of Patent: Jul. 6, 2010

(54) PRINTHEAD RESERVOIR WITH FILTER EXTERNAL TO JET FLUID PATH

(75) Inventors: David Paul Platt, Newberg, OR (US); David Roland Koehler, Sherwood, OR (US); Terrance L. Stephens, Molalla, OR (US); James Dudley Padgett, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 693 days.

(21) Appl. No.: 11/563,294

(22) Filed: Nov. 27, 2006

(65) Prior Publication Data

US 2008/0122912 A1 May 29, 2008

(51) Int. Cl.
*B41J 2/175* (2006.01)

(52) U.S. Cl. ..... 347/85; 347/87; 347/93

(58) Field of Classification Search ..... 347/85, 347/86, 87, 93

See application file for complete search history.

(56) References Cited

U.S. PATENT DOCUMENTS

| | | | | |
|---|---|---|---|---|
| 4,333,087 | A * | 6/1982 | Yamaguti | 347/93 |
| 4,947,191 | A * | 8/1990 | Nozawa et al. | 347/30 |
| 5,409,138 | A | 4/1995 | Nakano | |
| 5,546,109 | A * | 8/1996 | Nakano | 347/93 |
| 6,120,140 | A * | 9/2000 | Hirosawa et al. | 347/93 |
| 6,199,980 | B1 | 3/2001 | Fisher | |
| 6,217,164 | B1 * | 4/2001 | Hino | 347/85 |
| 6,296,352 | B1 * | 10/2001 | Hollands et al. | 347/86 |
| 6,398,354 | B1 * | 6/2002 | Lattuca et al. | 347/93 |
| 6,485,137 | B2 * | 11/2002 | Karlinski et al. | 347/92 |
| 6,520,633 | B2 * | 2/2003 | Nakamura | 347/93 |
| 2007/0109365 | A1 * | 5/2007 | Okuda | 347/85 |

FOREIGN PATENT DOCUMENTS

EP 1403063 A 3/2004

* cited by examiner

*Primary Examiner*—Anh T. N. Vo
(74) *Attorney, Agent, or Firm*—Marger Johnson & McCollom, P.C.

(57) ABSTRACT

A printhead reservoir has an input ink port and a chamber to receive ink from an ink source through the input ink port. The reservoir also has a filter in a path between the input ink port and the chamber. A printhead includes a reservoir having an input ink port, a chamber to receive ink from an ink source through the input port and a filter in a path between the input port and the storage plate. The printhead also includes an array of jets to draw ink from the chamber and control circuitry to control the jets so as to selectively output ink through the jets onto a substrate. A reservoir has a filter to receive ink, a vented chamber to collect ink received from the filter and at least one jet to receive ink from the vented chamber. The vented chamber is between the ink filter and the fluid path to the jets in order to remove the filter portion of the pressure drop to the jets.

17 Claims, 4 Drawing Sheets

PRINTHEAD RESERVOIR WITH FILTER EXTERNAL TO JET FLUID PATH

BACKGROUND

Solid ink printheads generally include an ink reservoir for molten ink, and the reservoir generally has a port between an ink storage chamber and an ink source, and channels leading to an array of jets or openings through which ink is dispensed. The printhead typically dispenses ink onto a printing substrate, such as paper, or an intermediate transfer surface such as a drum or belt. Most, if not all, solid ink reservoirs include a filter in the fluid path between the ink source and the jets to prevent particles from clogging up the jets.

In some approaches, the filter was in the jet fluid path, which is the fluid path between the chamber and the jets. A problem with this approach arises when the jets pull fluid and there is a pressure drop beyond a certain point. The filter resistance in the fluid jet path may cause the jets to pull a vacuum large enough to cause the jets to fail.

To overcome the filter resistance in the fluid path, one approach increases the size of the filter. However, the filter material may be expensive, increasing the cost of the printhead and the print system. As print system speeds increase, the jet fluid flow must also increase, requiring a larger filter. In addition, users desire smaller printers, and therefore smaller printheads. A smaller printhead having less filter surface area is counter to faster jetting speeds.

SUMMARY

One embodiment comprises a printhead reservoir. The reservoir has an input ink port and a chamber to receive ink from an ink source through the input ink port. The reservoir also has a filter in a path between the input ink port and the chamber.

Another embodiment comprises a printhead. The printhead includes a reservoir having an input ink port, a chamber to receive ink from an ink source through the input port and a filter in a path between the input port and the storage chamber. The printhead also includes an array of jets to draw ink from the chamber and control circuitry to control the jets so as to selectively output ink through the jets onto a substrate.

Another embodiment comprises a reservoir having a filter to receive ink, a vented chamber to collect ink received through the filter and at least one jet to receive ink from the vented chamber.

DETAILED DESCRIPTION

Figure 1:
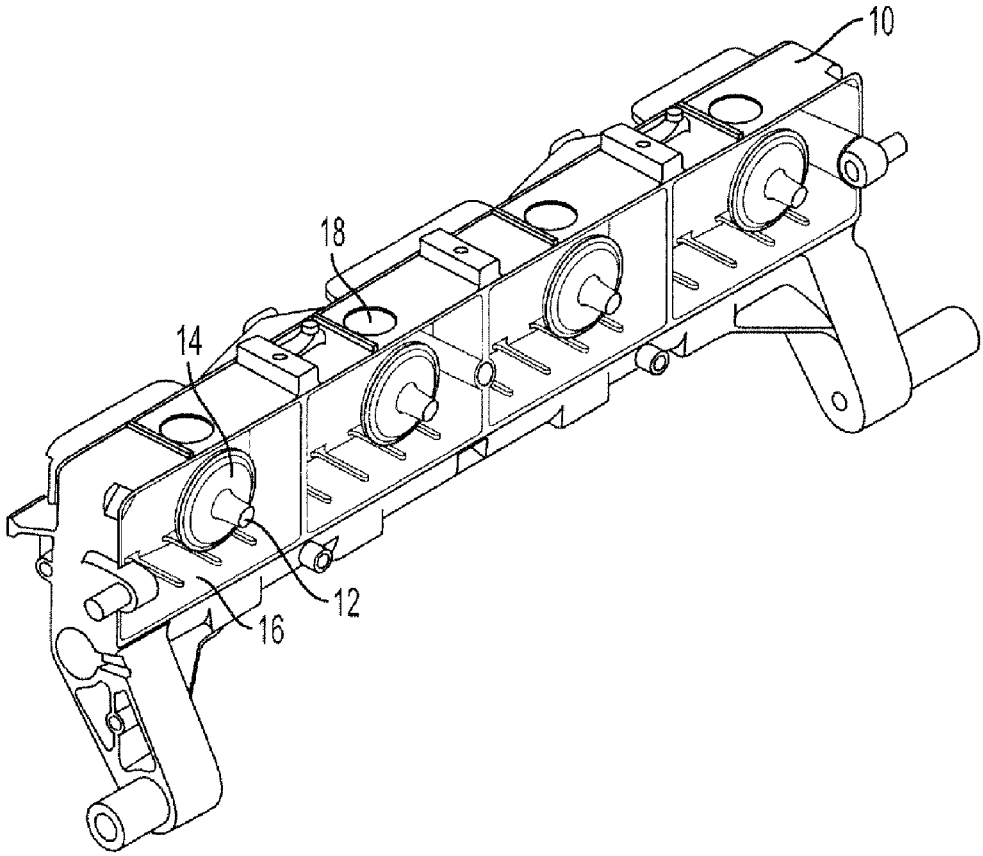
FIG. 1 shows a back view of a printhead reservoir.

FIG. 1 shows a back view of a printhead reservoir. A printhead reservoir contains the ink that the ink jets will eventually spray onto a printing substrate, whether directly, such as onto paper, or indirectly, such as onto a transfer or intermediate surface. The printhead reservoir mates with a circuit board or other actuator means that control the operation of the array of jets. The circuit board and its coupling to the jets may be referred to as the 'jet stack.'

The jets draw the ink from a chamber within the reservoir. An ink port allows the chamber to be filled with ink. In some instances, the ink port receives pressurized ink through a hose. A filter generally prevents particulates from getting into the ink and causing problems with the jetting process. Particulates may clog the jets, causing them to fail or fire off axis.

Current implementations of the filter place the filter in the jet fluid path, the path from the chamber to the jets. This may cause a pressure drop across the filter such that the jets 'pull a vacuum' in turn causing the jet or jets to fail. The jets have to pull the ink through the filter in these implementations. One solution to overcome this increases the size of the filter, but that increases the cost because the filter material is expensive, and increases the size of the reservoir to accommodate the increased surface area of the filter necessary to avoid the pressure drop.

The printhead reservoir of FIG. 1 has moved the filter out of the jet fluid path, while still keeping the filter in the ink path to regulate particulates in the ink. The reservoir 10 has input ink ports such as 12, which couple to a filter 14. The filter 14 filters the ink entering the port prior to reaching the chamber 16. The back plate of the reservoir may have molded or otherwise formed recesses or cavities to accommodate the filters. With or without the cavities, the back plate may also be referred to as the filter plate. The reservoir may comprise a filter plate, a front reservoir and an outlet plate. The 'front' reservoir is the reservoir that actually feeds the jets, contrasted with the back reservoir from where the pressurized ink is delivered.

The chamber 16 is vented to the surrounding atmosphere through a vent hole 18. This alleviates the issues with pressure drop across the filter, as the chamber can regulate its own pressure. The vent hole 18 will generally also have an air filter to prevent particulates from contaminating the ink in the chamber 16.

Figure 2:
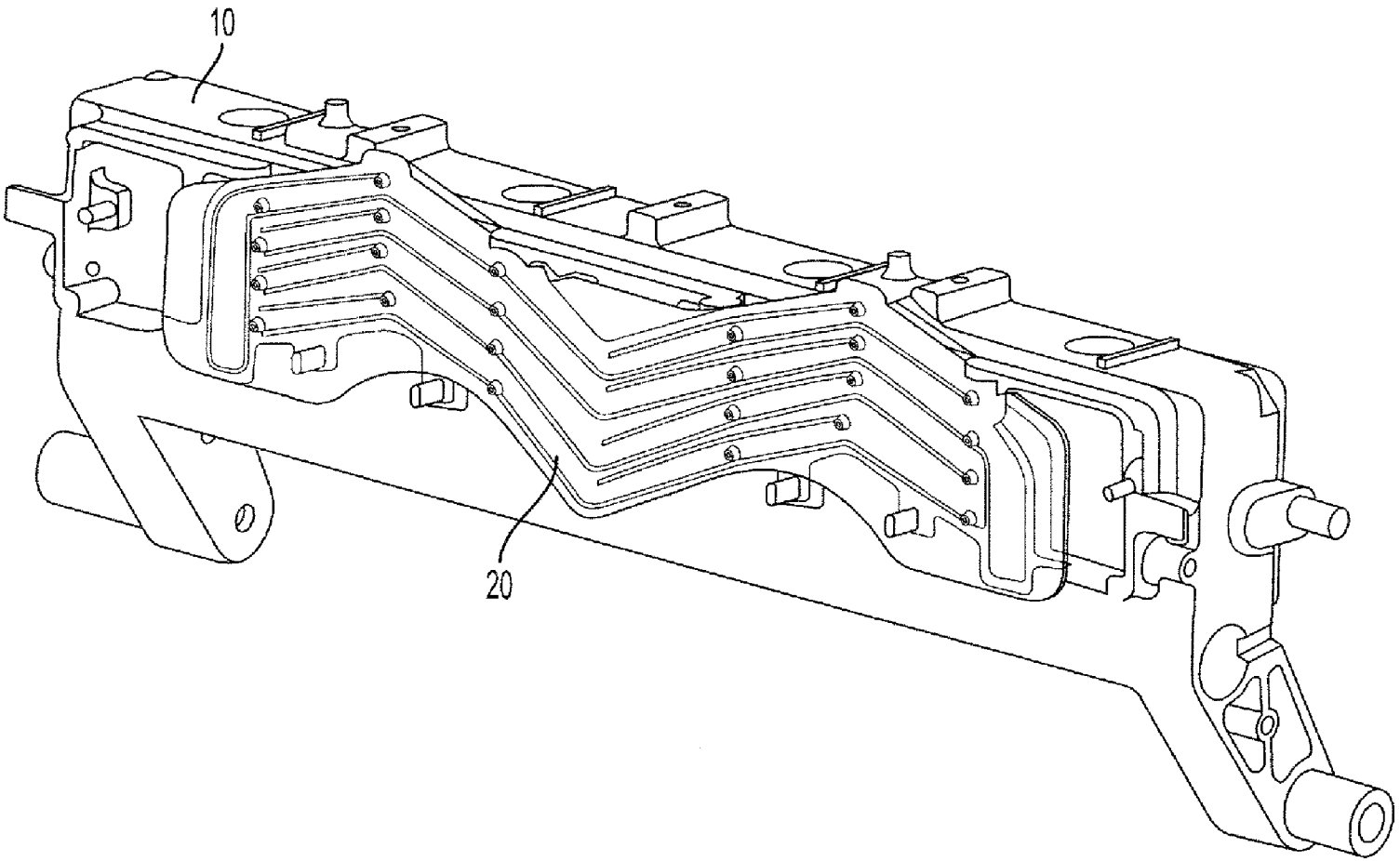
FIG. 2 shows a front view of a printhead reservoir.

FIG. 2 shows a front face or outlet plate of the reservoir 10. The outlet plate may have several channels such as 20 to direct the ink from the chamber to the jets. The circuit board comprising the jet stack would couple to the outlet plate to control the operation of the jets.

Figure 3:
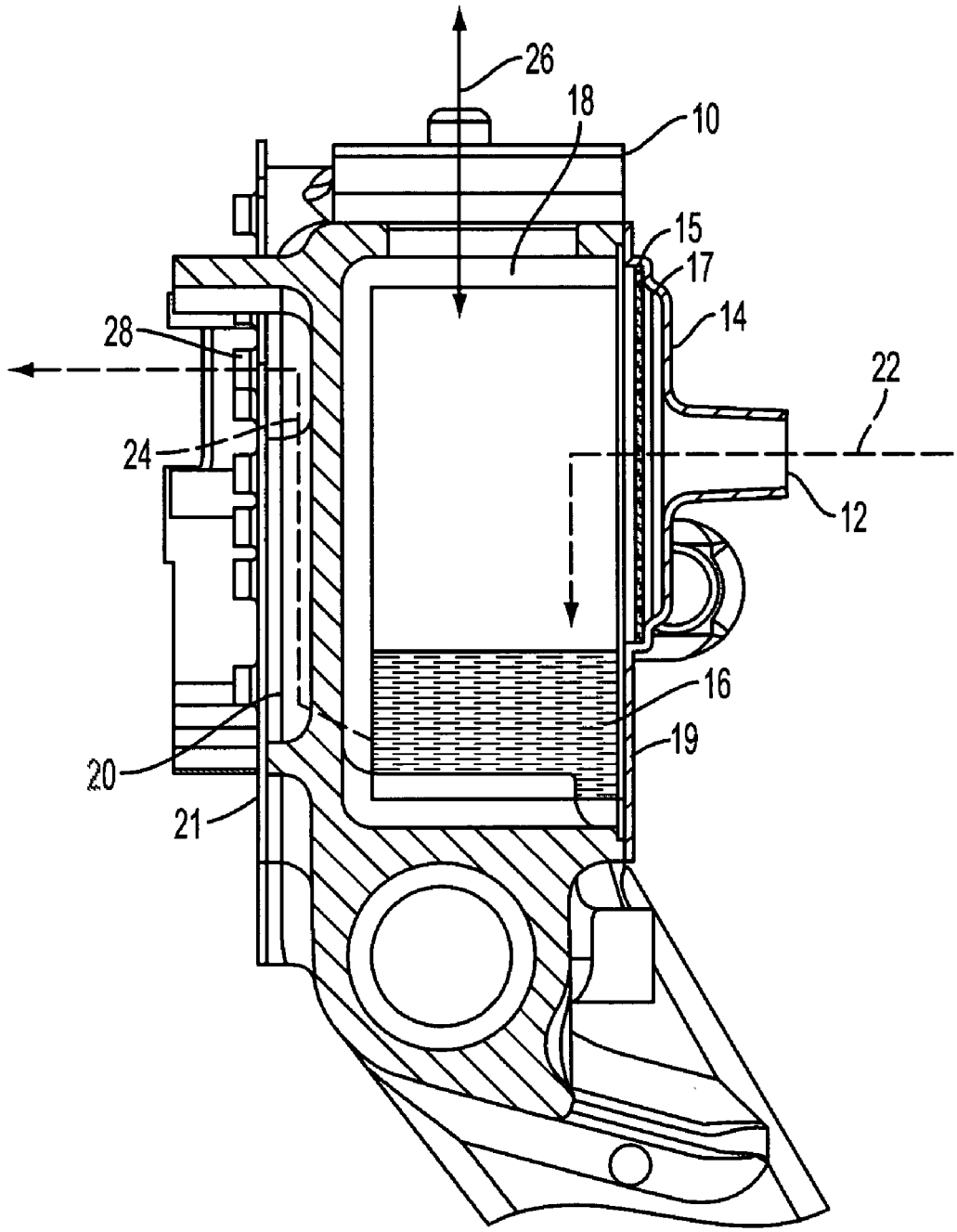
FIG. 3 shows a cross-sectional view of a printhead reservoir.

FIG. 3 shows a side or cross-sectional view of an embodiment of a reservoir. The reservoir 10 has two fluid paths in this example. The first fluid path comprises the input fluid path 22 where the ink enters through the ink port 12 and collects in the chamber 16. The chamber 16 has vent hole 18, which comprises the air flow path 26.

The second fluid path is the jet fluid path 24. The ink travels the jet fluid path from the chamber 16 through the channel 20 to the outlet to the jet 28. As mentioned in the discussion of FIG. 2, the outlet plate 20 of FIG. 2 couples to the circuit board 21 that provides control circuits for operation of the jets. The filter has moved from the jet fluid path, where it causes the problems with excessive pressure drop mentioned above, to the input fluid path. This move allows the jets to pull ink without having the issues with pressure drop. The air flow path 26 also contributes to the alleviation of this problem, allowing the chamber to self-regulate the pressure.

It must be noted that the filter placement in this particular embodiment is outside the vented chamber. The placement of the filter with regard to any particular component is optional. However, implementation of the embodiments of the invention should place the filter 'upstream' of a vented chamber between the filtered ink and the jets. In the embodiment of FIG. 3, the filter is outside the vented chamber prior to the input ink port.

Figure 4:
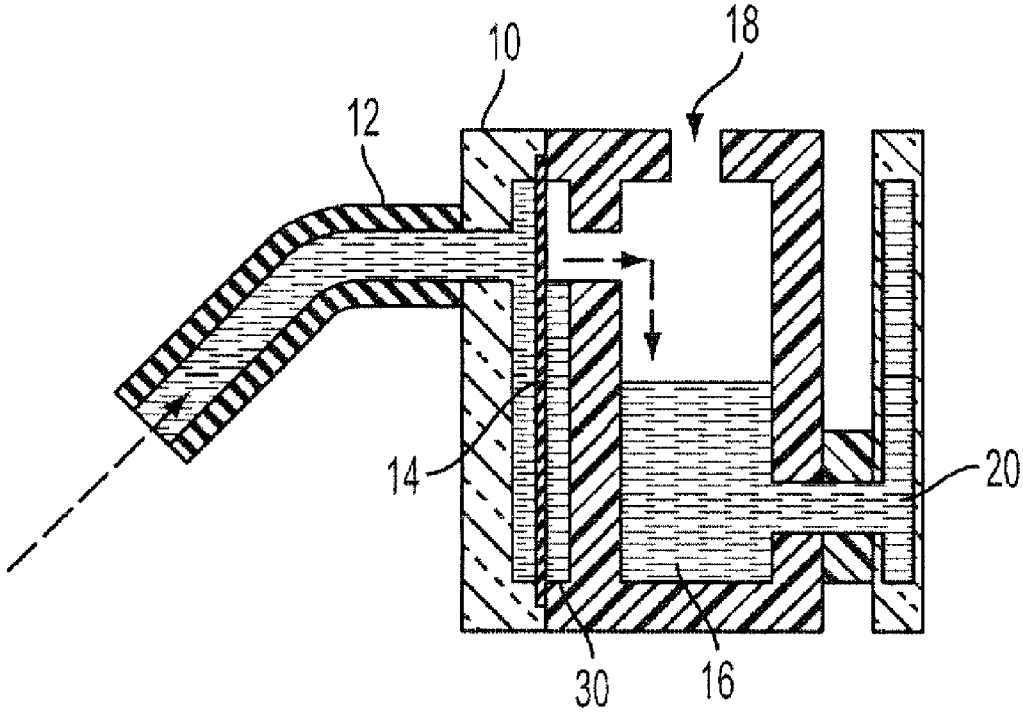
FIG. 4 shows a cross-sectional view of an alternative printhead reservoir.

FIG. 4 shows an alternative placement of the filter, inside the reservoir, but prior to the vented chamber. The ink enters the reservoir through the ink port 12. The filter 14 is actually internal to the reservoir, between the ink port and the vented chamber 16, still residing in the input fluid path. The ink may fill the 'intermediate' chamber 30, passing through the filter 14, and spill over into the vented chamber 16. The vent hole 18 allows the chamber 16 to self-regulate its pressure. The jets can then draw the ink through the channel 20 without experiencing the pressure drop.

As mentioned above, particular embodiments of the reservoir do not limit application of the invention. The filter placement should be in the input fluid path, with a vented chamber lying between the input ink and the jets. This allows the jets to pull ink from a self-regulated pressure chamber, and still allows the filter to filter the ink.

Returning to FIG. 1, a particular embodiment of a filter is shown. In FIG. 1, the filter comprises a disc filter made up of a disc of stainless steel felt and a disc of stainless steel mesh both bonded to a formed plate, referred to as the filter plate. FIG. 3 shows these discs 15 and 17 bonded to filter plate 19. The filter discs and material mentioned above is an example, but it could be made from alternate materials or shapes. While expensive, the embodiments here use far less of the filter material in four small discs than embodiments using one large piece of filter material for each reservoir. Any materials may be used for the support structure, in this instance the aluminum filter plate. The use of aluminum may have advantages if the rest of the reservoir is constructed out of aluminum as they have the same mechanical properties.

Similarly, it should be noted that the reservoir of FIG. 1 has four input ports, one each for the colors cyan, magenta, yellow and black. This example implies no limitation and none should be inferred. The use of a filter in the fluid path has no limitations as to the number of colors of ink, the types of ink or the size of the reservoir.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

The invention claimed is:

1. A reservoir comprising:
- a filter plate;
- an output plate;
- an input ink port located in the filter plate;
- a front reservoir chamber formed by the filter plate and the output plate, the chamber arranged to receive ink from a back reservoir through the input ink port and having vents between the chamber and a surrounding atmosphere; and
- a filter in a path between the input ink port and the chamber, the filter coupled to the filter plate.

2. The reservoir of claim 1, comprising at least one jet to draw ink from the chamber.

3. The reservoir of claim 2, comprising a jet fluid path between the chamber and the jet.

4. The reservoir of claim 1, comprising an input storage path between the chamber and the input port.

5. The reservoir of claim 1, the input ink port comprising a plurality of input ink ports, and the filter comprising a plurality of filters such that each input ink ports having a separate filter.

6. The reservoir of claim 1, the filter comprising a disc filter.

7. The reservoir of claim 6, the disc filter comprising a stainless steel felt disc and mesh disc bonded together to the filter plate.

8. The reservoir of claim 1, the filter plate having at least one cavity to accommodate the filter.

9. A printhead comprising:
- a reservoir comprising:
  - an input ink port;
  - a front reservoir chamber to receive ink from a back reservoir through the input port having vents between the chamber and the surrounding atmosphere; and
  - a filter in a path between the back reservoir and the chamber, prior to the input ink port;
- an array of jets to draw ink from the chamber; and
- control circuitry to control the jets so as to selectively output ink through the jets onto a substrate.

10. The printhead of claim 9, the reservoir comprising a filter plate, the chamber, and an outlet plate.

11. The printhead of claim 10, the outlet plate having at least one port to allow the ink to be drawn from the reservoir to the jets.

12. A reservoir, comprising:
- a filter to receive ink, the filter mounted to a filter plate;
- a vented chamber, including a vent that is vented to the surrounding atmosphere, to collect ink received from the filter, the filter mounted to the filter plate external to the chamber; and
- at least one jet to receive ink from the vented chamber.

13. The reservoir of claim 12, the reservoir comprising a pressurized ink input line to send ink to the filter.

14. The reservoir of claim 12, the reservoir arranged to provide a storage tank between the vented chamber and the at least one jet.

15. The reservoir of claim 12, the reservoir comprising at least one channel between the vented chamber and the at least one jet.

16. The reservoir of claim 12, the filter comprising a disc filter.

17. The reservoir of claim 12, the vented chamber having vents to a surrounding atmosphere.

* * * * *